US007160124B2

(12) United States Patent
Bhutani

(10) Patent No.: US 7,160,124 B2
(45) Date of Patent: Jan. 9, 2007

(54) ELECTRICAL PLUG WITH A SLIDABLE EARTH PIN

(75) Inventor: Gurmeet S. Bhutani, Pasig (PH)

(73) Assignee: Astec International Limited, Hong Kong (HK)

( * ) Notice: Subject to any disclaimer, the term of this patent is extended or adjusted under 35 U.S.C. 154(b) by 0 days.

(21) Appl. No.: 11/213,217

(22) Filed: Aug. 25, 2005

(65) Prior Publication Data

US 2006/0046539 A1 Mar. 2, 2006

Related U.S. Application Data

(60) Provisional application No. 60/605,793, filed on Aug. 30, 2004.

(51) Int. Cl.
*H01R 13/648* (2006.01)

(52) U.S. Cl. ..... 439/103

(58) Field of Classification Search ..... 439/103, 439/104, 171, 172, 177
See application file for complete search history.

(56) References Cited

U.S. PATENT DOCUMENTS

| | | | | |
|---|---|---|---|---|
| 2,876,426 | A * | 3/1959 | Morse | 439/104 |
| 3,025,486 | A * | 3/1962 | Falconer | 439/103 |
| 3,134,631 | A * | 5/1964 | Whalen | 439/104 |
| 3,733,576 | A * | 5/1973 | Cooper | 439/103 |
| 4,078,848 | A * | 3/1978 | Blairsdale | 439/103 |
| 4,201,431 | A * | 5/1980 | McDonald | 439/103 |
| 4,954,091 | A | 9/1990 | Marble et al. | |
| 5,159,545 | A * | 10/1992 | Lee | 363/146 |
| 5,427,541 | A | 6/1995 | Calio | |
| 5,791,921 | A * | 8/1998 | Lee | 439/172 |
| 6,053,750 | A * | 4/2000 | Waible | 439/106 |
| 6,247,941 | B1 * | 6/2001 | Lee et al. | 439/105 |
| 6,419,504 | B1 | 7/2002 | Nelson | |

FOREIGN PATENT DOCUMENTS

GB 2 313 242 A 11/1997

OTHER PUBLICATIONS

Nokia, Rotatable Earth Pin Design Photograph, best available copy, no copyright information available.

* cited by examiner

*Primary Examiner*—Tulsidas C. Patel
*Assistant Examiner*—Vladimir Imas
(74) *Attorney, Agent, or Firm*—Nixon Peabody LLP

(57) ABSTRACT

An electrical plug is disclosed with a slidable earth pin that can be manually positioned in a stored position in a plug body of the electrical plug when the electrical plug is not in use. The slidable earth pin is movable in the channel and retained by an interlocking mechanism between the earth pin and the channel on the plug body. The earth pin has a pair of protruding fingers that snap into a first set of grooves in the channel of the plug body in a first position, and that snap into a second set of grooves in the channel of the plug body in a second or stored position. When the earth pin is in its stored position, the physical dimension of the plug is significantly more compact than conventional three pin plugs.

12 Claims, 5 Drawing Sheets

ELECTRICAL PLUG WITH A SLIDABLE EARTH PIN

CROSS REFERENCE TO RELATED APPLICATION

This application claims the benefit of U.S. provisional application Ser. No. 60/605,793 filed Aug. 30, 2004.

FIELD OF INVENTION

The invention relates generally to electrical plugs and more particularly to electrical plugs having movable earth pins.

BACKGROUND OF THE INVENTION

A wide variety of electrical devices typically draw AC power from a commercial source, usually delivered through a wall receptacle or socket, via a corresponding electrical plug.

A conventional electrical plug typically has a pair of conductive power pins for insertion into corresponding female connectors in the socket. The plug typically also includes an earth or ground pin that is inserted into a corresponding female connector in the socket that is coupled to ground. In one or more countries, the earth pin is slightly longer than the power pins and also functions to open a spring loaded shutter in the socket, to allow insertion of the power pins into their respective female connectors in the socket. This safety feature thus requires that an earth pin be included in all plugs even when there is no need for a ground connection.

Battery chargers comprise one type of electrical device whose plugs typically do not require an earth or ground connection. However, to provide the shutter opening function, a dummy ground pin still needs to be provided. Such prior art earth pins are usually in a fixed position on the electrical plug, which makes the electrical plug unnecessarily bulky.

One prior art method for repositioning the earth pin in an electrical plug is to connect the earth pin to a hinge, to enable the pin to be rotated between two positions, an open position and a stored position. The pin is rotated 90° between these two positions about the axis of the hinge.

Consumers of electrical products in recent times have shown a desire for more compact designs. Accordingly, there is a need to reduce the amount of space taken up by an electrical plug when not in use, to enable the plug to be more compact.

SUMMARY OF THE INVENTION

The present invention describes an electrical plug with a slidable earth pin that can be moved into the body of the electrical plug when the electrical plug is not in use. The electrical plug has a slidable earth pin that is positioned in a channel formed in the plug body. The earth pin has a pair of fingers that snap into a first set of grooves in the channel of the plug body to position the earth pin in a first or functional position. The pair of fingers can also snap into a second set of grooves in the channel of the plug body to position the earth pin in a second or stored position. When the earth pin is slid into its stored position, the physical dimension of the electrical plug is significantly reduced, thereby providing a more convenient and compact electrical plug.

Broadly stated, an electrical plug according to the present invention comprises a plug body, a first conductive blade; a second conductive blade; an earth pin having a first finger and a second finger; a channel having a first left snap groove and a first right snap groove for enabling the earth pin to be retained in a first position, and having a second left snap groove and a second right snap groove for enabling the earth pin to be retained in a second position; and wherein the earth pin can be slidably positioned such that said fingers can be manually positioned in respective first snap grooves or in respective second snap grooves. In one embodiment, the earth pin is not removable with a force less than a specified safety norm after the earth pin has been inserted. Advantageously, the present invention provides an electrical plug design that reduces the physical dimension of the electrical plug when not in use.

Other structures and methods regarding the present invention are disclosed in the detailed description below. This summary does not purport to define the invention. These and other embodiments, features, aspects, and advantages of the invention will become better understood with regard to the following description, appended claims and accompanying drawings.

Reference symbols or names are used in the figures to indicate certain components, aspects or features therein, with reference symbols common to more than one figure indicating like components, aspects of features shown therein.

DETAILED DESCRIPTION OF PREFERRED EMBODIMENTS

Figure 1A:
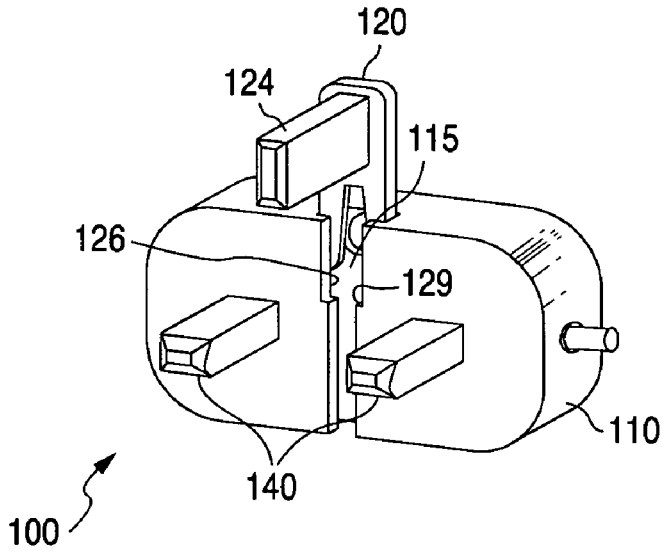
FIGS. 1A–1B illustrates perspective views of a slidable earth pin plug in accordance with a first embodiment of the present invention.
Figure 1B:
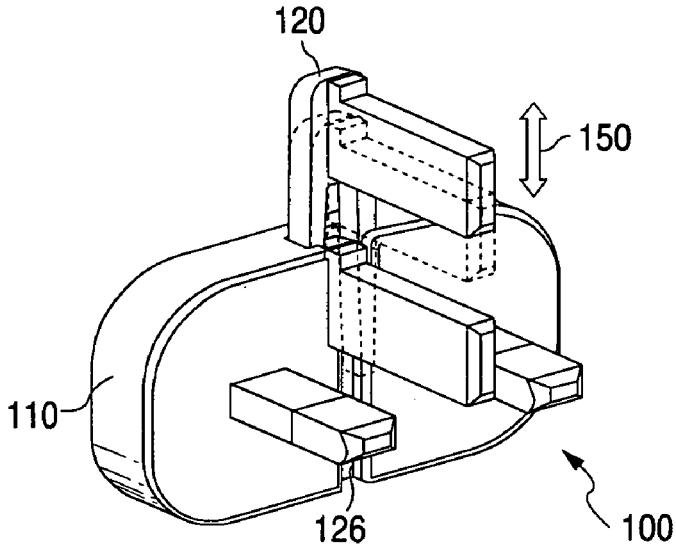

Referring now to FIGS. 1A–1B, there are shown perspective views of a slidable earth pin plug 100 in accordance with a first embodiment of the present invention. The slidable earth pin plug 100 comprises a plug body 110, a slidable earth pin 120, including an earth pin blade 124, and a pair of conductive blades 140. The slidable earth pin 120 is manually slidable in a vertical direction in a channel 115 formed in the plug body 110 between the pair of conductive blades 140, as indicted by an arrow 150 in FIG. 1B.

Figure 2A:
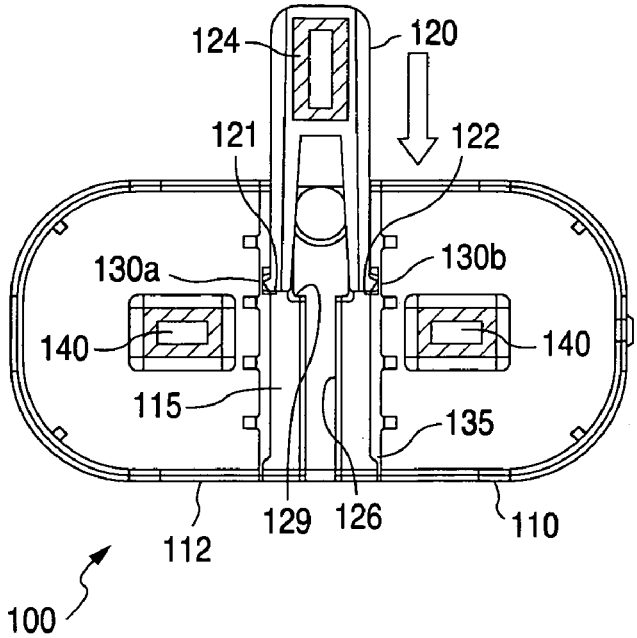
FIG. 2A illustrates a sectional view of the slidable earth pin plug in a first or functional position.
Figure 2B:
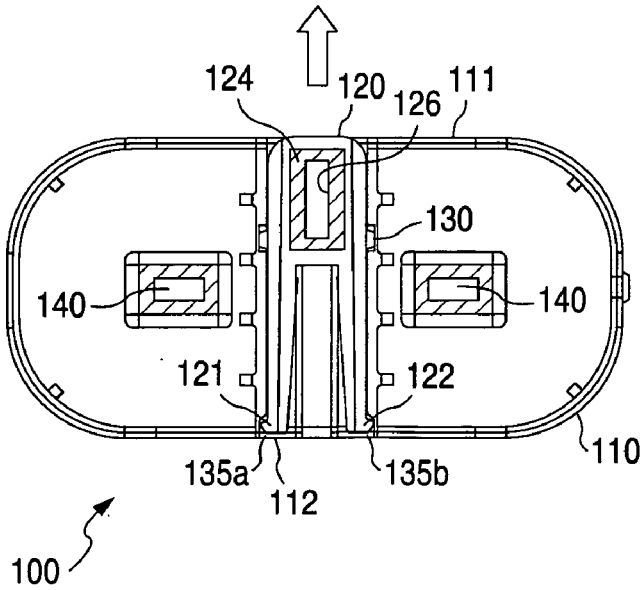
FIG. 2B illustrates a sectional view of the slidable earth pin plug in a second or stored position of the earth pin in accordance with the first embodiment of the present invention with the front panel removed.

The slidable earth pin 120 in plug 100 can be manually displaced from a first or "functional" position to a second, stored position, as shown in FIGS. 2A and 2B, respectively. In its first position, the slidable earth pin 120 is in a position where the top end of the earth pin 120 protrudes from the plug body 110 a sufficient distance to enable the earth pin blade 124 to be in a functional position, i.e., where it can be inserted into a corresponding female connector in a socket at the same time, or in advance of when the conductive blades 140 are inserted into similar corresponding female connectors in the socket, all as specified by the plug/socket standards of the country in which the plug is to be used. In its stored position, the entire length of the slidable earth pin 120 is preferably within the channel 115 and inside the plug body 110 so that the slidable earth pin 120 does not protrude beyond a top surface 111 of the plug body 120 or beyond the bottom surface 112 of the plug body 120.

FIGS. 2A–2B also illustrate the means by which earth pin 120 is releasably retained at its respective first and second positions. Earth pin 120 includes first and second fingers 121 and 122 that are compressed slightly when earth pin 120 is first inserted into channel 115, as described in greater detail below. In its first position, as shown in FIG. 2A, earth pin 120 is retained in channel 115 by a first left snap groove 130*a* wherein the first finger 121 is positioned, and by a first right snap groove 130*b* wherein the second finger 122 is positioned, such that the earth pin 120 interlocks with the plug body 110. When the electrical plug 100 is not is use, the earth pin 120 can be manually pushed down the channel 115 to a second or stored position, as shown in FIG. 2B, and held in place by the operation of the first finger 121 snapping into a second left snap groove 135*a* and the second finger 122 snapping into a second right snap groove 135*b*.

Note that, in its second or stowed position, earth pin 120 provides an indication that an attempted insertion of plug 100 into a socket is incorrect. That is, in its second position, earth pin 120 protrudes out from plug body 110 in the direction of conductive blades 140 in a position that will not align with a socket's ground pin socket hole, thereby preventing the insertion of plug 100 into the socket when earth pin 120 is in this position.

As seen in the views of the present invention shown in FIGS. 1 and 2, earth pin 120 is prevented from being pushed to a position below the point where first and second fingers 121 and 122 snap into second left and right grooves 135*a* and 135*b* because of the existence of a narrowing in a slot 126 formed at the front of channel 115. This narrowing is perhaps best seen at 128 in FIG. 3. Consequently, as the earth pin 120 is pushed down the slot, the bottom surface of the earth pin blade 124 makes contact with surface 129 of slot 126, thereby preventing further travel of the earth pin 120 down channel 115.

As is seen in FIGS. 2A and 2B, fingers 121 and 122, as well as left and right grooves 130*a* and 130*b* include surfaces that enable fingers 121 and 122 to be moved out of these grooves with a modest amount of manual force applied to the earth pin 120 in the desired direction of travel.

Figure 3:
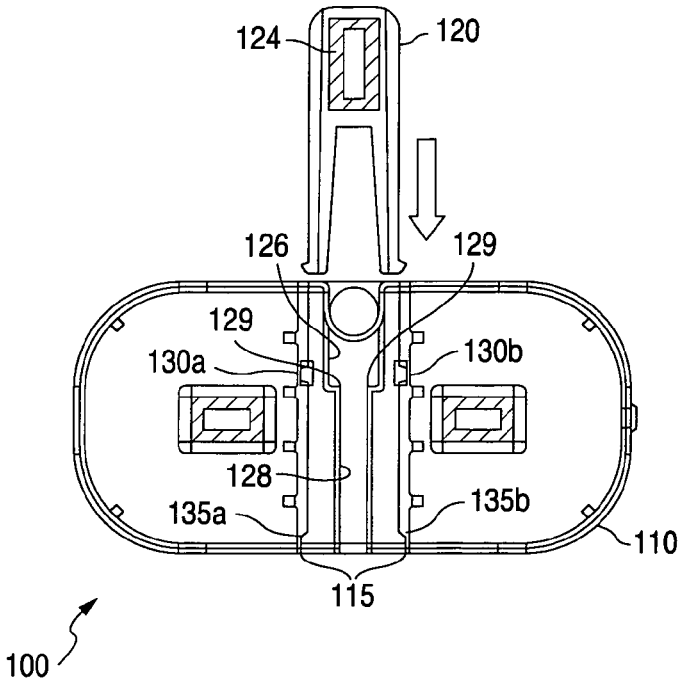
FIG. 3 illustrates the assembly of the slidable earth pin plug in accordance with the first embodiment of the present invention with the front panel removed.

In FIG. 3, there is a pictorial diagram illustrating a step in the assembly of the slidable earth pin plug 100 wherein the earth pin is first inserted into channel 115. In this step, earth pin plug 100 is being inserted into the channel 115 of the plug body 110, either manually with hand pressure or using a tool or fixture. Once inserted, the upper surfaces of grooves 130*a* and 130*b* may be shaped in a conventional way known in the art to make it difficult for the earth pin 120 to thereafter be removed from channel 115 in a direction opposite to the direction of insertion.

As perhaps better seen in FIG. 3, channel 115 includes two sets of snap grooves, a first set comprising first left snap groove 130*a* and first right snap groove 130*b*, and a second set comprising second left snap groove 135*a* and second right snap groove 135*b*. The narrowing of slot 126 in the area shown at 128 creates ledges 129.

Figure 6A:
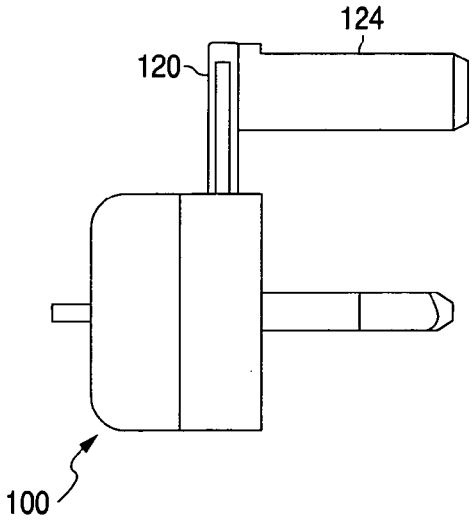
FIGS. 6A–6B are respective side and front views of the slidable earth pin plug in accordance with the first embodiment of the present invention.
Figure 6B:
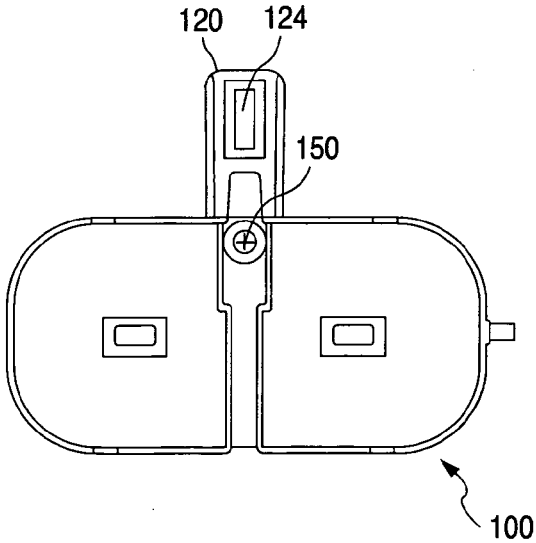
Figure 4A:
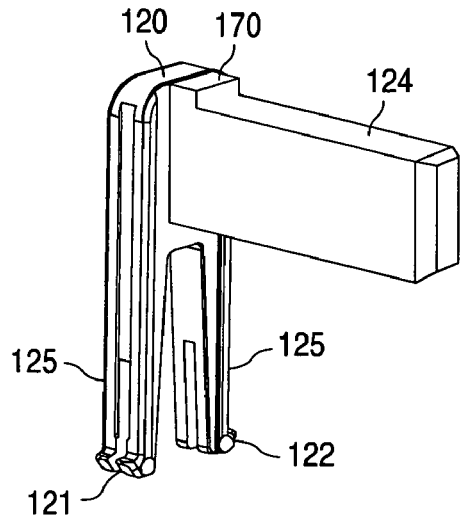
FIGS. 4A–4B are detailed perspective views respectively illustrating the slidable earth pin and its sliding contact fingers and the assembly of the slidable earth pin plug in accordance with the first embodiment of the present invention.
Figure 4B:
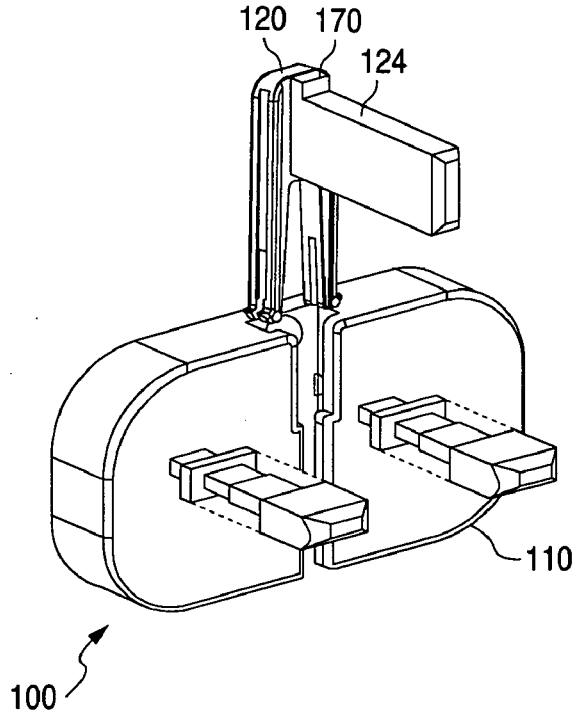

A detailed perspective view illustrating earth pin 120 of the first embodiment of the present invention is shown in FIGS. 4A and 4B. As seen in these figures, earth pin 120 includes a vertical section 125 that terminates in fingers 121 and 122 (i.e., the sliding contact surface area) for sliding in the channel 115 of the plug body 110. The compressive force of fingers 121 and 122 along the sides of channel 115 is selected so as to maintain a preferred level of sliding friction in moving the earth pin 120 up and down channel 115. The earth pin 120 can even be inserted at a vendor as part of the post-moulding operation. Side and front views of the electrical plug 100 are shown in FIGS. 6A and 6B.

In FIGS. 4A–4B, there are shown perspective views of an edge stop 170 that is preferably formed on the top surface of earth pin 120. This surface 170 is positioned to ensure that an end user inserts the earth pin 120 a predetermined distance into an electrical outlet (not shown), and no farther.

Figure 5A:
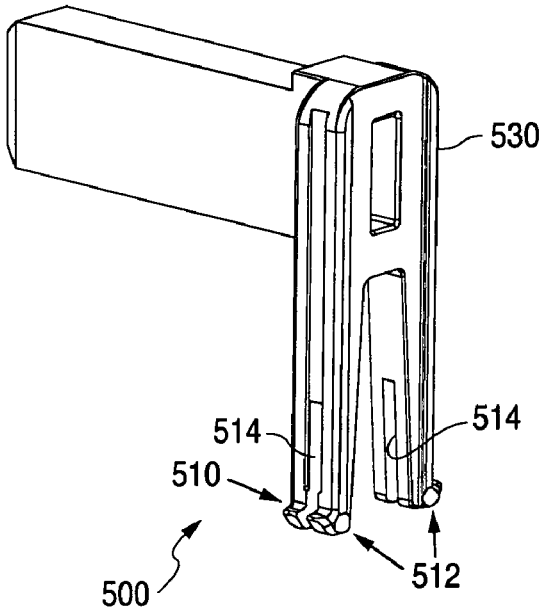
FIG. 5A is a detailed perspective view illustrating an earth pin and its sliding contact fingers for a slidable earth pin plug in accordance with a second embodiment of the present invention.
Figure 5B:
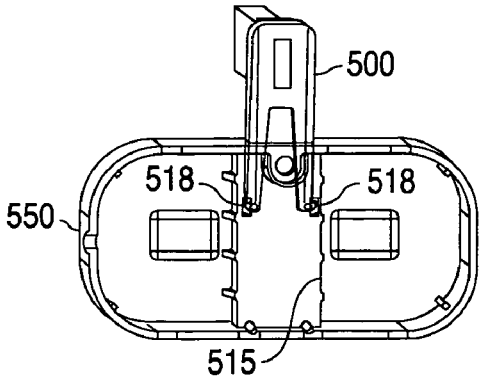
FIG. 5B is a perspective rear view and 5C is a rear view illustrating the earth pin of FIG. 5A assembled in the slidable earth pin plug in accordance with the second embodiment of present invention with the back panel removed.
Figure 5C:
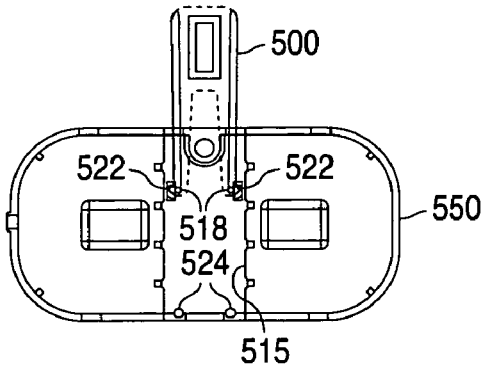

Turning now to FIG. 5A, there is shown a detailed perspective view illustrating an earth pin 500 and its first and second sliding contact fingers according to a second embodiment of the present invention. FIG. 5B and 5C illustrate the slidable earth pin plug with the rear removed to show the structurally different aspects of earth pin 500 as compared to earth pin 120 described above. The earth pin 500 of the second embodiment is designed with a dual lock approach, where each of the sliding contact fingers has a first set of finger locks 510 that is parallel to a second set of finger locks 512. The first set of finger locks 510 is used for locking the earth pin 500 in slot 515 by means of ledges 518 of the upper mating grooves 522, as seen in FIG. 5B. The purpose of the first set of finger locks 510 is to prevent the earth pin 500 from popping out of a plug body 550 after the earth pin 500 has been inserted into the slot 515 in plug body 550. The second set of finger locks 512, as seen in FIG. 5C, is used for positioning the earth pin 510 in either a folded position or an unfolded position, as well as providing the user with an indication of proper fitting between the earth pin 500 and the plug body 550 by the sounding of a click when the second set of finger locks 512 has been mated with upper mating grooves 522 or with lower mating grooves 524. A slot 514 in the earth pin 500 is provided to impart flexibility to an arm 530 having the second set of finger locks 512.

In a third embodiment of the present invention, the earth pin 120 or 500 is not removable with a force less than a specified safety norm after the earth pin 120 or 500 has been inserted. The finger locks 122 and the grooves 130*a* and 130*b* in the first embodiment, and the finger locks 510 and the ledges 518 in the second embodiment are designed to implement this safety feature of the third embodiment.

In a preferred embodiment, earth pin 120 or 500 is a non-conductive dummy pin for use in a battery charger or the like where there is no need for a ground connection but where the earth pin 120 or 500 is just needed to open the spring loaded shutter of the socket in which the plug is to be inserted. One of the ordinary skill in the art should recognize that the present invention can be applied to different types of electrical plugs in various regions or countries. One suitable application is on plugs as used in the United Kingdom.

Those skilled in the art can now appreciate from the foregoing description that the broad techniques of the embodiments of the present invention can be implemented in a variety of forms. Therefore, while the embodiments of this invention have been described in connection with particular examples thereof, the true scope of the embodiments of the invention should not be so limited since other modifications, whether explicitly provided for by the specification or implied by the specification, will become apparent to the skilled practitioner upon study of the drawings, specification, and following claims.

The invention claimed is:

1. An electrical plug, comprising:

a first conductive blade;

a second conductive blade;

a slidable earth pin having an earth pin blade, a first finger and a second finger; and a plug body including a channel having a first left snap groove and a first right snap groove positioned to receive said first and second fingers, respectively, for enabling said earth pin to be positioned in a first position, and having a second left snap groove and a second right snap groove positioned to receive said first and second fingers, respectively, for enabling said earth pin to be positioned in a second position;

wherein the slidable earth pin is selectively manually movable back and forth in said channel between said first and said second positions.

2. The electrical plug of claim 1, wherein when the slidable earth pin is in said first position, an interlocking mechanism is formed between the slidable earth pin and the plug body by a compressive force asserted by each of said fingers, such that said first finger is releasably retained in the first left snap groove and said second finger is releasably retained in the first right snap groove.

3. The electrical plug of claim 1, wherein when the slidable earth pin is in said second position, an interlocking mechanism is formed between the slidable earth pin and the plug by a compressive force asserted by each of said fingers, such that said first finger is releasably retained in the second left snap groove and said second finger is releasably retained in the second right snap groove.

4. The electrical plug of claim 1, wherein the earth pin comprises an edge stop for ensuring that the earth pin is inserted a predetermined distance and no farther into an electrical socket.

5. The electrical plug of claim 1, wherein said earth pin fingers have sliding contact surfaces for sliding in said channel and wherein each said finger asserts a force against the sides of said channel of a predetermined amount to maintain a selected level of sliding friction between said earth pin and said plug body.

6. The electrical plug of claim 1, wherein the first left snap groove and the first right snap groove include upper surfaces that retain the earth pin within said channel after the initial insertion of the earth pin into said channel unless a force is applied to the earth pin that is greater than a specified safety norm.

7. An electrical plug, comprising:

a first conductive blade;

a second conductive blade;

a slidable earth pin having an earth pin blade, a first finger and a second finger, said first finger having a first pair of finger locks and said second finger having a second pair of finger locks, each of said first and second fingers having a slot between the first and second finger locks; and a plug body including a channel having upper mating grooves positioned to receive said first and second fingers, respectively, for enabling said earth pin to be positioned in a first position, and having lower mating grooves positioned to receive said first and second fingers, respectively, for enabling said earth pin to be positioned in a second position for storing said slidable earth pin in said plug body;

wherein the slidable earth pin is selectively manually movable in said channel back and forth between said first and said second positions.

8. The electrical plug of claim 7, wherein when the slidable earth pin is in said first position, an interlocking mechanism is formed between the slidable earth pin and the, plug body by a compressive force asserted by each of said fingers, such that said first set of finger locks is releasably retained against a ledge in the upper mating grooves.

9. The electrical plug of claim 7, wherein when the slidable earth pin is in said second position for storing, an interlocking mechanism is formed between the slidable earth pin and the plug by a compressive force asserted by each of said fingers locks, such that each of said second finger locks is releasably retained in the lower corresponding mating grooves.

10. The electrical plug of claim 9, wherein the earth pin comprises an edge stop for ensuring that the earth pin is inserted a predetermined distance and no farther into an electrical socket.

11. The electrical plug of claim 7, wherein the earth pin does not extend above said plug body when said earth pin is in said second position.

12. The electrical plug of claim 7, wherein said channel includes a slot in which the earth pin moves between said first and second positions, said slot including a narrowed section that begins at a point below the position of the earth pin when the earth pin is in said second position, to prevent the positioning of the earth pin below said second position.

* * * * *